United States Patent [19]

Engle, Jr. et al.

[11] 4,114,393

[45] Sep. 19, 1978

[54] LATERAL SUPPORT MEMBERS FOR A TENSION LEG PLATFORM

[75] Inventors: Donald D. Engle, Jr., Brea; Michael E. Utt, Placentia, both of Calif.

[73] Assignee: Union Oil Company of California, Brea, Calif.

[21] Appl. No.: 807,905

[22] Filed: Jun. 20, 1977

[51] Int. Cl.[2] ..... E02B 17/00

[52] U.S. Cl. ..... 114/264; 405/210; 114/256; 405/211

[58] Field of Search ..... 61/86, 87, 94, 98, 101; 114/256, 257, 264, 265

[56] References Cited

U.S. PATENT DOCUMENTS

| | | | |
|---|---|---|---|
| 2,777,669 | 1/1957 | Willis et al. | 61/94 X |
| 3,559,410 | 2/1971 | Blenkarn et al. | 61/87 |
| 3,978,804 | 9/1976 | Beynet et al. | 61/98 X |
| 3,982,492 | 9/1976 | Steddum | 61/98 X |
| 3,983,706 | 10/1976 | Kalinowski | 61/98 |

*Primary Examiner*—Mervin Stein
*Assistant Examiner*—David H. Corbin
*Attorney, Agent, or Firm*—Richard C. Hartman; Dean Sandford; Daniel R. Farrell

[57] ABSTRACT

Apparatus and method for mooring a tension leg platform at an offshore location wherein the tensioned cables of the platform legs are laterally supported by a plurality of rigid, fixed-dimensioned support members which interconnect the legs and are vertically spaced at predetermined positions along the cables to reduce the unsupported length thereof and to thereby increase the fundamental frequency of the cables to a value higher than the flutter frequencies likely to be encountered. Resonant fluttering of the cables due to vortex shedding is thereby prohibited and the useful life of the cables is extended. The support members can be variably buoyant and/or can be adapted to provide storage for fluids produced at the offshore location.

13 Claims, 5 Drawing Figures

LATERAL SUPPORT MEMBERS FOR A TENSION LEG PLATFORM

BACKGROUND OF THE INVENTION

1. Field of the Invention

This invention relates to the mooring of structures used in the exploration for and production of oil and gas at offshore locations, and particularly to an apparatus and method for mooring tension leg platforms.

2. Description of the Prior Art

One form of marine structure proposed for use in the exploration for and production of oil and gas at offshore locations especially in deep water, is the tension leg platform (TLP). The TLP comprises a working structure which is supported by its own buoyancy and which is drawn down to the desired working position by three or more tension cable legs connecting the working structure to a plurality of anchors on the ocean floor. The tensioned cables restrict the movement of the working structure and render the TLP relatively insensitive to the natural forces of wind and waves which would otherwise tend to displace and disturb the working structure.

Characteristics of the TLP which render it particularly suited for use in deep waters include: the time required for construction and placement of the TLP is considerably less than for other platform designs which are supported by steel or concrete columns from the ocean floor; since only longer cables and possibly heavier anchors are required to increase the operating depth of the TLP, the cost of the TLP is relatively insensitive to water depth as compared to the bottom-supported platforms; and the TLP is more readily salvagable at the end of an unsuccessful exploration program or at the completion of a production program.

One problem encountered when the TLP is used in deep waters is that tension cable fatigue can be accelerated by the fluttering induced by the flow of water past the tensioned cables. This effect is particularly serious when the flutter frequency is near a natural or resonant frequency of the cable. Resonant flutter induced by vortex shedding has been shown to be detrimental to marine cables (Vandiver et al., "A Field Study of Vortex-Excited Vibrations of Marine Cables", paper OTC 2491 presented at the Eighth Annual Offshore Technology Conference in Houston, Tex. in May 1976) to marine risers (U.S. Pat. No. 3,978,804 to Beynet et al.) and to marine pipelines (Mes, M. J., "Vortex Shedding Can Cause Pipe Lines to Break", *Pipeline and Gas Journal,* August, 1976). U.S. Pat. No. 3,978,804 discloses the use of a plurality of riser spacers, along the length of the riser legs of a vertically moored platform (VMP), to change the natural or resonant frequency of the individual risers above the flutter frequencies caused by the motion of the water past the risers. The riser spacers are rigid templates which support the risers of each platform leg against lateral movement in order to prevent collision between the risers and reduce the unsupported length of each riser. However, the individual legs of the platform are not interconnected and the risers of each leg are able to flutter as a group. In order to avoid this problem, the templates are designed so as to increase the drag effect of the overall system in order to dissipate this flutter energy. This increased drag, however, renders the platform more susceptible to severe natural forces.

In the drilling of offshore wells from a floating platform, it is necessary to use a riser, commonly known as a marine riser, which extends from the working deck of the platform to the subsea wellhead. The riser is in effect an elongated enclosure which surrounds and protects the drill string and other pipes and tools which are passed from the platform to the wellhead, or vice versa. During the drilling of the well, the riser also provides an enclosed pathway for the return of drilling fluids to the working deck. The riser is normally tensioned to prevent bending or buckling and to thereby reduce the friction between the drill string and the riser. For a tension leg platform moored with tensioned cables, the risers are suspended from the center portion of the platform, as compared to other types of moored platforms in which the risers are positioned at the perimeter of the platform and also serve as the platform legs.

The drilling from the VMP of U.S. Pat. No. 3,978,804 is done through the risers of the platform legs and because the risers are located at the perimeter of the platform, another problem associated with this platform is that the risers are subject to damage due to torsion of the platform caused by severe natural forces, which, during the drilling of wells, would cause the drillstring to scrape against the risers and damage them.

The problem of distortion of the riser during drilling operation from a tension leg platform is addressed by U.S. Pats. Nos. 3,996,755 and 3,983,706 to Kalinowski, which discloses the use of one or more adjustable riser bracing devices which serve to dynamically position the centralized riser to reduce the lateral distortion thereof caused by severe natural conditions. While perhaps stabilizing the riser, the adjustment of the braces during platform displacement due to natural forces significantly increases the tension on the leg cables thereby severely stressing the tensioned cables and resulting in either a draw-down of the floating structure or, alternatively, a lifting of the subsea anchors, both of which events are more significant problems during severe weather conditions than the distortion of the riser pipe.

Hence, a need exists for a simple but effective method for reducing the rate of fatigue of the tension cables and risers of a tension leg platform due to resonant flutter without adversely affecting other characteristics of the platform.

It is therefore a primary object of this invention to provide a method and apparatus for mooring a buoyant structure at offshore locations.

Another object of this invention is to provide a method and apparatus for mooring tension leg platforms at offshore locations such that the useful life of the tension legs is prolonged.

Still another object of this invention is to provide a simple but effective mooring system for a tension leg platform which eliminates resonant flutter of the tension legs and thereby substantially reduces cable fatigue.

Other objects and advantages of this invention will become apparent to those skilled in the art from the following description taken in conjunection with the accompanying drawings.

SUMMARY OF THE INVENTION

Briefly, this invention provides a method and apparatus for mooring a tension leg platform in which a plurality of rigid, fixed-dimensioned support members are provided at predetermined, vertically-spaced positions along the length of the platform legs. The support members interconnect the platform legs and serve to reduce the unsupported length of the cables of each leg, thereby increasing the fundamental frequency of the cables to a value higher than the flutter frequencies likely to be encountered.

In one particularly preferred embodiment of this invention, the support members are variably buoyant so as to be optionally negatively, neutrally or positively buoyant and are used to distribute the tension of the tensioned cables evenly along the length thereof and/or to reduce the required weight of the platform anchors.

In another preferred embodiment of this invention, when used in offshore areas where the prevailing current varies with the water depth, the support members are spaced at irregular intervals along the length of the platform legs such that the spacing is relatively small at the water depths exhibiting high velocity currents and the spacing is relatively large at water depths exhibiting low velocity currents. The number of support members required is thereby reduced as compared to the use of an equal spacing based on the highest velocity currents encountered.

The mooring system of this invention is relatively simple in design, and it effectively reduces cable fatigue and distortion of marine risers without adversely affecting other platform characteristics. A tension leg platform using the mooring system of this invention is not as subject to severe damage of the marine riser due to torsion of the platform during rough weather as are other types of vertically moored platforms, and the rates of fatigue of the tension cables and the riser are effectively reduced without adversely affecting the other.

BRIEF DESCRIPTION OF THE DRAWINGS

The invention will be more readily understood by reference to the accompanying drawings, in which.

DETAILED DESCRIPTION OF THE INVENTION

Figure 1:
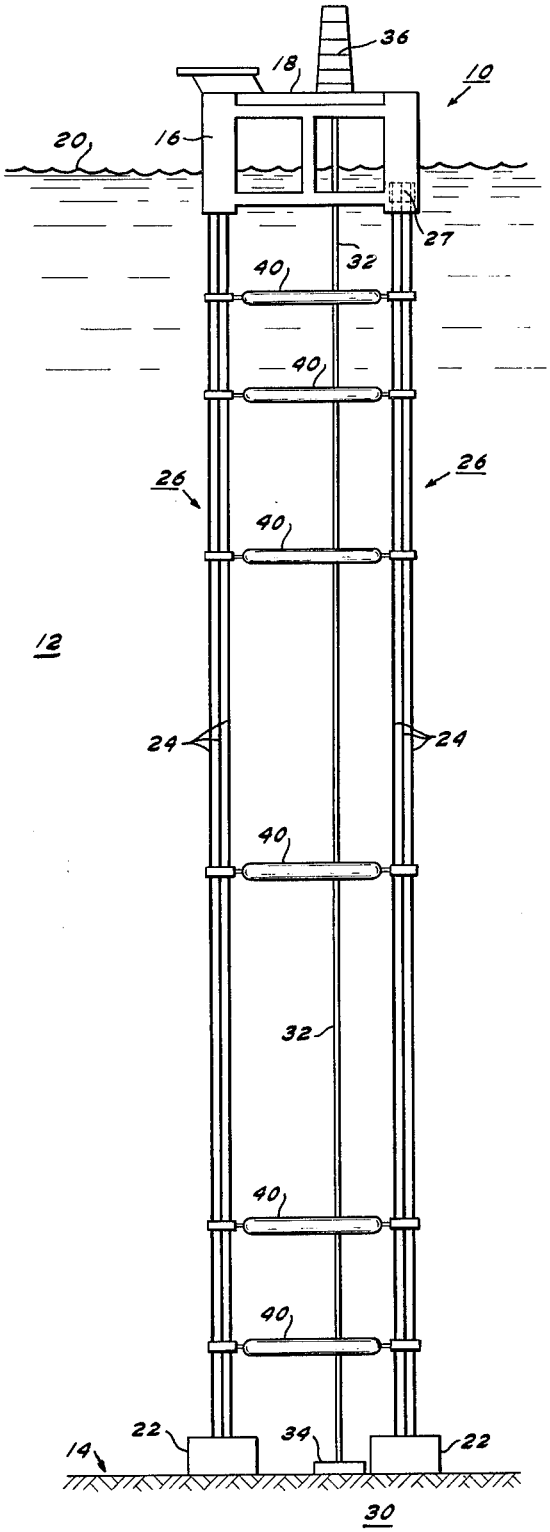
FIG. 1 is an elevation view of a tension leg platform at an offshore location which is anchored to the ocean floor by the mooring system of this invention.

The tensioned cables which moor the buoyant working structure of a tension leg platform (TLP) to the deadweight anchors on the ocean floor are subject to cyclic lateral displacement due to the shedding of von Karman vortices. This cyclic displacement, or flutter, stresses the cable and can lead to early fatigue and failure. The frequency of the flutter due to vortex shedding is dependent upon the velocity of the water flowing past the cables. When this flutter frequency is near a resonant frequency of the cable, the frequency of the vortex shedding tends to "lock onto" the resonant frequency of the tensioned cable. When this occurs the rate of fatigue of the cable is accelerated. This locked-in condition is herein referred to as "resonant flutter". The large cyclic stressing of the cables due to resonant flutter is avoided by use of the mooring system of this invention.

It is known in classical flutter theory that the flutter frequency is proportional to the relative velocity of the fluid, i.e., higher relative velocities develop flutter at higher frequencies. Therefore, the design of the mooring system of this invention which is intended to increase the fundamental frequency, i.e. the lowest resonant frequency, of the tensioned cables to a value higher than the flutter frequencies likely to be encountered, will of course depend on the relative velocity of the water flowing past the tensioned cables. That is, the mooring system is designed such that the fundamental frequencies $F_n$ of the cables and the marine riser are higher than the highest anticipated flutter frequency $F_f$ so as to avoid flutter lock-in to resonant flutter.

The methods for determining $F_f$ and $F_n$ are known in the literature and are generally set out in U.S. Pat. No. 3,978,804. Briefly, the flutter frequency $F_F$ is:

$$F_f = 0.22\ V/D$$

where:

$V$ = relative velocity of water past the cable or riser, $D$ = diameter of the cable or riser.

Since the diameter of the tension cables is generally smaller than the diameter of the marine riser, the flutter frequency due to vortex shedding is generally higher for the smaller diameter cables.

By determining the maximum velocity, $V(x)$, likely to be encountered at different water depths, $x$, at the offshore location, the flutter frequency, $F_f(x)$, for the cables and riser as a function of water depth can be calculated and is defined as follows:

$$F_f(x) = 0.22\ V(x)/D.$$

The fundamental frequency $F_n$ of a cable or riser is:

$$F_n = 0.5/L\ \sqrt{(T \cdot G)}/W$$

where:

L = unsupported length of the cable or riser,

W = weight per unit length of the cable or riser,

G = acceleration of gravity,

T = tension on the cable or riser.

In order to avoid resonant flutter, the flutter frequency at all water depths must be less than the fundamental frequency of the cables and riser at that depth. That is:

$$F_f(x) < F_n, \text{ at all water depths } x.$$

Accordingly, the unsupported length L must be:

$$L < 0.5\ D/[0.22\ V(x)]\sqrt{(T \cdot G)}/W.$$

Since flutter at a frequency near a resonant frequency will normally lock onto the resonant frequency, a small safety margin should be provided. Preferably, the unsupported length $L(x)$ of the riser and the cables as a function of the water depth $x$ is as follows:

$$L(x) < 2D/[V(x)]\sqrt{(T \cdot G)}/W.$$

Depending on several factors including the materials of construction and the amount of tension applied to the cables and the riser, the length L for the cables will generally be shorter than the length L for the riser; therefore, of course, the length L for the cables, i.e., the shorter of the two lengths, will be used to vertically position the rigid support members.

Referring to FIG. 1, a tension leg platform, shown generally as 10, is positioned in a body of water 12 above the ocean floor 14. Platform 10 comprises a buoyant structure 16 which supports a working deck 18 above the surface 20 of the body of water 12. A plurality of dead weight anchors 22 rest on ocean floor 14 and optionally can be affixed thereto by piles, not shown. At various points, usually the corners, about the perimeter of buoyant structure 16, there is provided a plurality of cables 24. The cables 24 at each such position about the perimeter of buoyant structure 16 make up one platform leg, shown generally as 26. Cables 24 extend from structure 16 to anchors 22. Generally, one anchor 22 is provided for each platform leg 26. Cables 24 are fixedly, or preferably pivotally, attached to anchors 22 by means of clamps or trunions, not shown. Cables 24 are adjustably attached to structure 16 by a tensioning device 27 which serves to regulate the tension of the cables whereby structure 16 is drawn down to a desired working depth in body of water 12. By use of tensioned cables 24 to moor the buoyant structure 16, the tension leg platform 10 is rendered relatively resistant to lateral and/or vertical displacement of working deck 18 due to the forces of wind and water.

A subterranean formation 30 below ocean floor 14 can be explored by drilling a well from TLP 10. A marine riser 32 is provided between working deck 18 and a template 34 on ocean floor 14 to provide an enclosed pathway for passage of a drill string and other well tools, not shown, between working deck 18 and ocean floor 14. Wellhead equipment, not shown, such as blowout preventors and other control valves, is generally provided at working deck 18 or at template 34 to control the well fluids during drilling operations. Drilling is conducted from deck 18 with a derrick 36 through marine riser 32 in the conventional manner. The above-described tension leg platform is well known in the art and the various components and design criterion therefor are set out in one or more of U.S. Pat. Nos. 3,540,396 to Horton, 3,563,042 to Ryan, 3,982,492 to Steddum and 3,955,521 to Mott, which are herein incorporated by reference.

In accordance with the mooring system of this invention, a plurality of rigid, fixed-dimensioned support members 40 are provided at predetermined vertical intervals along the length of platform legs 26. Support members 40 are substantially horizontal and interconnect each platform leg 26. Support members 40 can be simple trusses extending between legs 26 which are provided with clamping devices for fixed attachment to each cable 24. Conventionally, tension leg platforms are polygonal-shaped with between about 3 and about 5 sides and have 3, 4 or 5 platform legs. The configuration of support members 40 will vary accordingly, i.e., for a TLP having 3 legs, support members 40 are preferably a triangular-shaped member; for a TLP having 4 legs, support members 40 are preferably rectangular members, and so on.

It is critical that the support members interconnect the platform legs. By interconnecting separate legs of the TLP, the natural resonant frequency of the cables is increased more than by mere interconnection of the cables of each leg, because interconnection of the legs substantially increases the effective diameter of the structure effected by vortex shedding. U.S. Pat. No. 3,978,804 discloses, for example, that mere interconnection of the individual risers of a leg of a vertically moored platform still allows the risers to flutter as a group. By interconnecting the platform legs, the cables of each leg could not flutter as a group, but rather the entire TLP would have to flutter. The natural frequency of the entire TLP is much higher than that of the individual unsupported legs.

It is also critical that the support members utilized are of fixed dimensions. By "fixed-dimensioned" it is meant that the support members do not alter the horizontal distance between the platform legs during lateral displacement of the platform. In both of the basic TLP designs, the vertical-leg TLP and the angled-leg TLP, the horizontal distance between legs remains constant. The angled-leg TLP allows no displacement of the buoyant structure and the vertical-leg TLP allows only small horizontal displacements, during which displacements it resembles a parallelogram. Any attempt to dynamically alter the horizontal distance between legs will subject the cables to severe stress and result in either an uplifting of the deadweight anchors or a drawing down of the buoyant structure. By the use of fixed-dimensioned support members, these undesirable occurrences are avoided.

The dimensions of the support members will depend upon the design of the particular TLP. For a vertical-leg TLP the platform legs are parallel and therefore the distance between them is the same at the buoyant structure and at the anchors. For an angled-leg platform, the legs are not parallel but rather are wider apart at one end, usually at the anchors, than the other. Preferably, the support members are dimensioned so that they do not alter the leg-to-leg distance at the point of attachment. Preferably the legs will be substantially straight from the buoyant structure to the respective anchors. Therefore for a vertical-leg TLP, the support members will all have the same dimensions, and for an angled-leg TLP, the dimensions of the individual support members will be different and will depend on the distance between legs at the particular position of the support.

Figure 2:
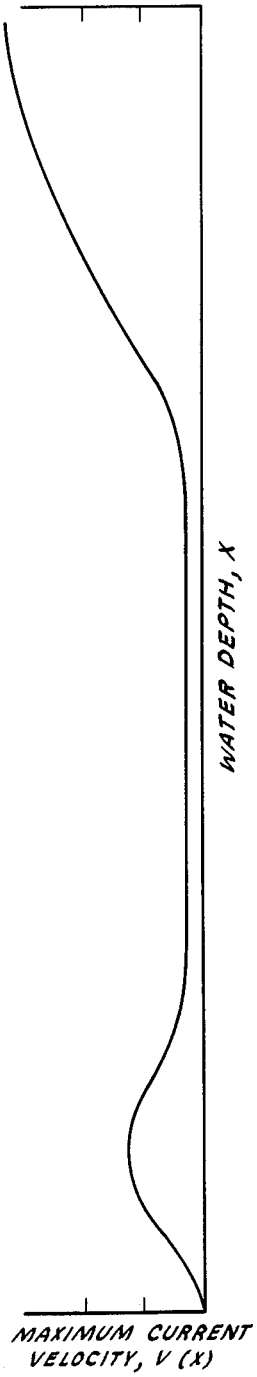
FIG. 2 is a graphical representation illustrating the relative current velocities at different water depths at the offshore location illustrated in FIG. 1.

Support members 40 are spaced at predetermined positions along the length of platform legs 26 so as to reduce the unsupported length of cables 24 and preferably riser 32 and thereby increase the resonant frequencies of these members to a value above the flutter frequencies likely to be encountered. FIG. 2 illustrates the maximum anticipated water velocity $V(x)$ as a function of water depth $x$. The maximum current near the surface of the body of water is relatively high, whereas the maximum current at intermediate water depth is low. As is relatively common, a moderate velocity bottom current is evident near the floor of the body of water. As discussed above, the unsupported length L must be small if the maximum current velocity is high, and rigid support members 40 are positioned accordingly in FIG. 1. Spacing L between adjacent supports is relatively small near surface 20 but large at intermediate water depth and small again near ocean floor 14. The determination of the function $V(x)$ and the use thereof to position the support members enables the use of irregular spacing and consequently fewer support members while still avoiding resonant fluttering of the cables and riser due to vortex shedding.

The support members can be very simple truss structures provided with attachment devices, such as a clamping device, for fixed attachment to the tension cables. The design utilized for a particular platform is a matter of choice based on standard engineering considerations, including the strength and drag force of the support member. In a preferred embodiment, one or more of the support members are provided with means to alter their buoyancy, such as one or more hollow members or pontoons fixedly or removably attached to the support members. The hollow chambers preferably can be filled with fluids of varying densities, including gases, such as air, nitrogen or natural gases, or liquids, such as water or liquid hydrocarbons. The hollow chambers can also serve as storage tanks for fluids produced at the location.

The use of variably buoyant support members allows greater flexibility in the design and operation of the TLP. During the towing of the TLP to the offshore location, the hollow chambers can be rendered positively buoyant by filling them with air and thereby help the buoyant structure support heavier payloads and/or heavier deadweight anchors. In offshore locations having very deep waters where the weight of the long tension cables is sufficient to require a substantial tensioning force to draw down the buoyant structure to the desired working depth, the positioning of positively buoyant support members along the length of the cables helps support the weight of the cables and distributes the tension evenly along the length of the cables thereby reducing the rate of cable fatigue. Furthermore, any sagging of the legs of an angled-leg TLP can be eliminated by proper use of the variably buoyant support members. In other offshore locations, the support members can be rendered negatively buoyant by filling them with a dense fluid to supplement the weight of the anchors. Although it is preferred that the buoyancy is adjusted by introduction or removal of fluids from the chambers, it is also contemplated that slurries, such as a cement slurry, or a slurry of low density solids, could be used. The slurries are, however, less preferred due to the difficulty in removing the slurries from the chambers when desired.

Figure 3:
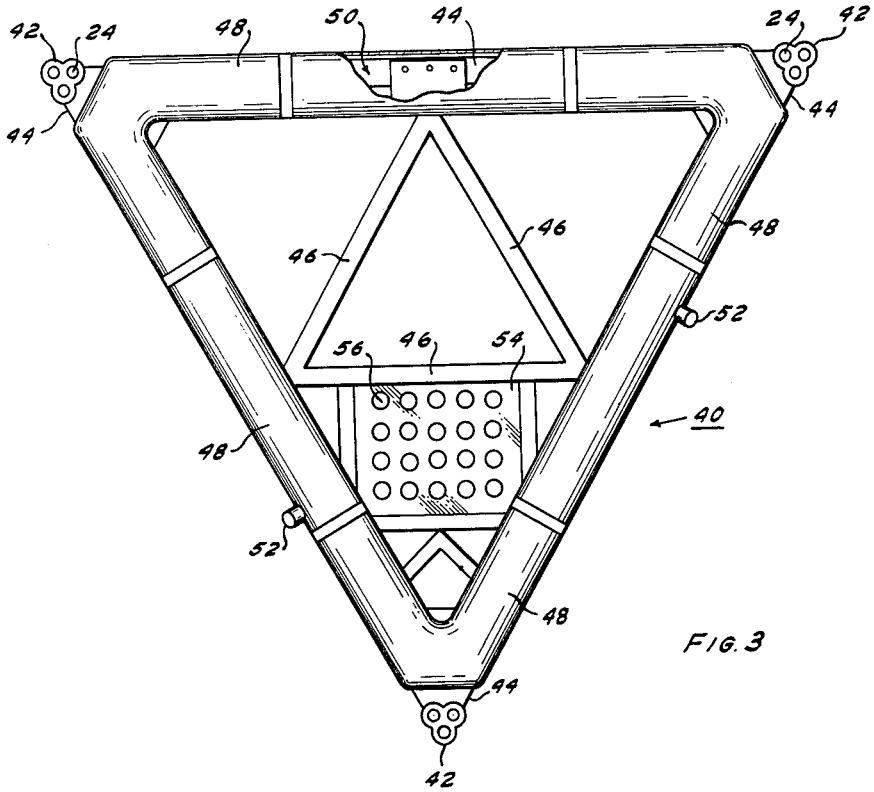
FIG. 3 is a plan view of one embodiment of the rigid support member of this invention.

FIG. 3 illustrates one embodiment of a variably buoyant support member which is useful in the mooring of a three-legged TLP. The support member, shown generally as 40, is a polygonal truss having one corner for each leg of the platform and a clamping device 42 at each corner. In the particular embodiment shown, clamping devices 42 are rigidly supported and interconnected by I-beam trusses 44 which form a triangular truss structure. A plurality of crossbeams 46 are provided to brace trusses 44. Each truss 44 is surrounded by a multi-chambered tubular shell 48, each of which defines a plurality of hollow chambers 50.

Hollow chambers 50 can be filled with compressed gas or other fluids to vary the buoyancy of support members 40. The fluids can be conducted to chambers 50 by one or more conduits, not shown, which provide a closed circulation system between the working platform and the support members. Alternatively, an access port 52 may be provided to each chamber 50 to permit entry of water from the surrounding body of water and/or exhausting of compressed air. Ballasting and deballasting systems are well known in the art and preferably a remotely controllable ballasting system is selected.

Preferably, a marine riser template 54 is provided on each member 40. Template 54 serves as a guide for the marine risers, keeping them parallel and separated and also serves as a lateral support to reduce the unsupported length of the risers and thereby help to avoid resonant fluttering, as discussed above. Template 54 has a plurality of spaced apertures 56 which are dimensioned just larger than the marine risers. Optionally, apertures 56 can be provided with flexible circular wipers or clamps, not shown, which restrict the opening of apertures 56 and provide slidable attachment between the riser and template 54.

Figure 4:
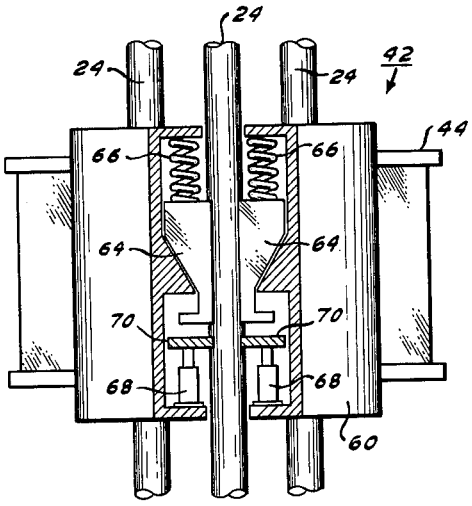
FIG. 4 is a vertical cross-sectional view taken along line 4-4 of FIG. 5 illustrating one embodiment of the cable clamping device used in the apparatus of this invention.
Figure 5:
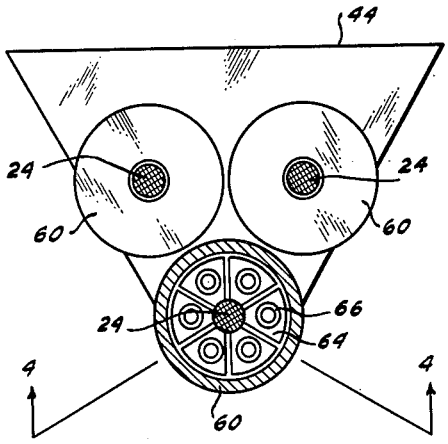
FIG. 5 is an enlarged, partially cut-away, top view of the cable clamping device.

One embodiment of clamping device 42 useful in attaching support members 40 to cables 24 is shown in FIGS. 4 and 5. In the particular embodiment shown, each platform leg consists of three tension cables 24. Clamping device 42 comprises three cylindrical housings 60, each of which surrounds and is coaxial with one of cables 24. As is best seen in FIG. 5, within housing 60, a plurality of wedge pieces 64 are spaced evenly about cable 24 and on top of each wedge piece 64 is a coil spring 66. Referring to FIG. 4, wedge piece 64 is an irregularly shaped solid with a flat inner face pressed against cable 24, and an arcuate cone-like outer face pressed against a cone-like ramp built into housing 60. Springs 66 force wedge pieces 64 downward against the ramp of housing 60 and thereby pinch wedge pieces 64 against cable 24 resulting in a firm attachment between cables 24 and clamping devices 42.

In the bottom of housing 60 a plurality of hydraulic cylinders 68 and a washer-shaped plate 70 are provided to release cable 24 from clamping device 42. Hydraulic cylinders 68 are connected to a source of hydraulic fluid by one or more conduits, not shown, and can be remotely activated. Extension of the hydraulic cylinders forces plate 70 up against the shoe of wedge piece 64, thereby compressing springs 66 and relieving the pressure on cable 24. Support members 40 can be positioned and repositioned along the length of cables 24 by use of the above-described clamping device.

While particular embodiments of the invention have been described, it will be understood, of course, that the invention is not limited thereto since many obvious modifications can be made, and it is intended to include within this invention any such modification as will fall within the scope of the appended claims.

Having now described the invention, we claim:

1. A platform for operations in a body of water at an offshore location, which comprises:

a working deck;

a buoyant structure for supporting said working deck above the body of water;

a plurality of anchors on the floor of the body of water;

a plurality of tension legs, each of said legs being comprised of one or more cables and being attached at one end to one of said anchors and at the other end to said buoyant structure;

tensioning means for applying tension to said cables and thereby drawing down said buoyant structure to a working position in the body of water; and one or more rigid, fixed-dimensioned support members interconnecting said legs and each of said cables, each of said support members being vertically positioned along the length of said cables between the buoyant structure and the anchors to reduce the unsupported length thereof such that the fundamental frequency of the unsupported sections of said cables is higher than the highest flutter frequencies likely to be encountered.

2. The apparatus defined in claim 1 wherein said support members are positioned such that the unsupported length L($x$) of said cables at all water depths x is defined as follows:

$$L(x) < 2D/[V(x)]\sqrt{(T \cdot G)}/W$$

wherein:

$D$ = the diameter of said cables, $V(x)$ = the maximum anticipated relative velocity of the water flowing past said cables at the water depth $x$, $T$ = the tension on the cables, $G$ = the acceleration of gravity, $W$ = the weight per unit length of said cables.

3. The apparatus defined in claim 1 including a marine riser extending between said buoyant structure and the floor of said body of water, and wherein said support members include means for laterally supporting said riser.

4. The apparatus defined in claim 1 including variable buoyancy means attached to said support members for adjusting the buoyancy of said support members.

5. The apparatus defined in claim 1 including storage means attached to said support members for storage of fluids produced at the offshore location.

6. A tension leg platform for operations in a body of water at an offshore location, which comprises:

a working deck;

a buoyant structure for supporting said working deck above the body of water;

a plurality of deadweight anchors on the floor of the body of water;

a plurality of substantially parallel tension legs each comprised of one or more cables, each of said legs being attached at one end to one of said anchors and at the other end to one of a plurality of points spaced about the perimeter of said buoyant structure;

tensioning means at said points for applying tension to said cables and thereby drawing down said buoyant structure to a working position in the body of water; and one or more rigid, fixed-dimensioned support members interconnecting said legs and each of said cables at vertical positions along the length of said cables between the buoyant structure and the anchors such that the unsupported length L($x$) of said cables at all depths $x$ in the body of water is defined as follows:

$$L(x) < 2D/[V(x)]\sqrt{(T \cdot G)}/W$$

wherein:

$D$ = the diameter of said cables, $V(x)$ = the maximum anticipated relative velocity of the water flowing past said cables at the water depth $x$, $T$ = the tension on the cables, $G$ = the acceleration of gravity, $W$ = the weight per unit length of said cables.

7. The apparatus defined in claim 6 including variable buoyancy means attached to said support members for adjusting the buoyancy of said members and thereby adjusting the tension of said cables.

8. The apparatus defined in claim 6 including a marine riser parallel to said tension legs and extending from the center portion of said working deck to the floor of said body of water, and wherein said support members include means for laterally supporting said riser.

9. The apparatus defined in claim 7 wherein said variable buoyancy means includes storage means for storage of fluids produced at the offshore location.

10. In the method for mooring a buoyant structure at an offshore location in a body of water wherein the buoyant structure is drawn down to a working position by applying tension to a plurality of spaced platform legs each comprised of one or more cables, each of which legs connect the buoyant structure to one of a plurality of anchors positioned at the bottom of the body of water, the improvement which comprises:

interconnecting said platform legs and each of said cables with one or more rigid, fixed-dimensioned support members; and vertically-positioning said support members at selected positions along the length of said legs between the buoyant structure and the anchors to reduce the unsupported length of said legs and thereby increase the fundamental frequency of the unsupported sections of said legs to a value higher than the flutter frequencies likely to be encountered, whereby the condition of resonant flutter is avoided and the useful life of said legs is prolonged.

11. The method defined in claim 10 wherein the maximum water velocity as a function of water depth ($x$) at said offshore location is V($x$) and wherein said support members are positioned such that the unsupported length L($x$) of said cables is defined as follows:

$$L(x) < 2D/[V(x)]\sqrt{(T \cdot G)}/W$$

wherein:

$D$ = the diameter of said cables, $T$ = the tension on said cables, $G$ = the acceleration of gravity, $W$ = the weight per unit length of said cables.

12. The method defined in claim 10 wherein said support members include means for adjusting the buoyancy of said support members, and including altering the buoyancy of said support members such that the tension of said cables is more uniformly distributed along the length thereof.

13. The method defined in claim 12 wherein said buoyant structure is an angled-leg tension leg platform and the buoyancy of said support members is adjusted to reduce the sag of said cables.

* * * * *

UNITED STATES PATENT OFFICE

CERTIFICATE OF CORRECTION

Patent No. 4,114,393 Dated September 19, 1978

Inventor(s) Donald D. Engle, Jr. and Michael E. Utt

It is certified that error appears in the above-identified patent and that said Letters Patent are hereby corrected as shown below:

In column 4, the formula on lines 41 to 42 should read:

$$F_n = \frac{0.5}{L} \sqrt{\frac{T \cdot G}{W}}$$

In column 4, the formula on lines 56 to 57 should read:

$$L < \frac{0.5\ D}{0.22\ V(x)} \sqrt{\frac{T \cdot G}{W}}$$

And the formula which is found in column 4, lines 63 to 64, in column 9, lines 3 to 4 (claim 2) and lines 49 to 50 (claim 6), and in column 10, lines 41 to 42 (claim 11) should read:

$$L(x) < \frac{2D}{V(x)} \sqrt{\frac{T \cdot G}{W}}$$

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*